US007367070B2

(12) United States Patent
Akkad

(10) Patent No.: US 7,367,070 B2
(45) Date of Patent: May 6, 2008

(54) COMBINATION TOY CHAIR AND SLEEPING BAG

(75) Inventor: Benjamin S. Akkad, Brooklyn, NY (US)

(73) Assignee: Idea Nuova, Inc., New York, NY (US)

( * ) Notice: Subject to any disclaimer, the term of this patent is extended or adjusted under 35 U.S.C. 154(b) by 50 days.

(21) Appl. No.: 11/102,257

(22) Filed: Apr. 8, 2005

(65) Prior Publication Data

US 2005/0172401 A1 Aug. 11, 2005

Related U.S. Application Data

(63) Continuation-in-part of application No. 10/382,318, filed on Mar. 4, 2003, now abandoned.

(60) Provisional application No. 60/361,829, filed on Mar. 4, 2002.

(51) Int. Cl.
*A47G 9/00* (2006.01)

(52) U.S. Cl. ..... 5/413 R; 5/417

(58) Field of Classification Search ..... 5/413 R, 5/417, 420

See application file for complete search history.

(56) References Cited

U.S. PATENT DOCUMENTS 4,754,512 A 7/1988 Chao-Yang
4,774,734 A 10/1988 Mills
D300,681 S 4/1989 DeMars
5,560,056 A * 10/1996 Tai ..... 5/413 AM
6,343,968 B1 2/2002 Louie et al.
6,367,083 B1 * 4/2002 November ..... 5/413 R
6,393,637 B1 * 5/2002 Hoffman ..... 5/413 R
6,421,852 B1 7/2002 Shao
6,463,604 B1 10/2002 Reveron et al.
6,543,072 B2 4/2003 Hsu
2002/0104162 A1 8/2002 Stewart
2004/0073985 A1 * 4/2004 Riccelli ..... 2/69
2004/0199998 A1 * 10/2004 Shinner ..... 5/482

FOREIGN PATENT DOCUMENTS

GB 2183148 A * 6/1987

* cited by examiner

*Primary Examiner*—Frederick L. Lagman
(74) *Attorney, Agent, or Firm*—Panitch Schwarze Belisario & Nadel LLP

(57) ABSTRACT

A combination toy chair and sleeping bag includes a toy chair having a base with an enclosed storage volume, a back, and a sleeping bag capable of being stored within the storage volume. The combination toy chair and sleeping bag is convertible between a chair configuration and a bedding configuration. The back may be made to resemble an animal, such as a bear.

14 Claims, 4 Drawing Sheets

COMBINATION TOY CHAIR AND SLEEPING BAG

CROSS-REFERENCE TO RELATED APPLICATIONS

This application is a continuation-in-part of abandoned U.S. patent application Ser. No. 10/382,318, "Novelty Bedding with Back Rest", filed Mar. 4, 2003, which claimed benefit of U.S. Provisional Patent Application No. 60/361,829, "Novelty Bedding with Back Rest", filed Mar. 4, 2002. Priority is claimed from both U.S. patent application Ser. No. 10/382,318 and U.S. Provisional Patent Application No. 60/361,829, both of which are incorporated herein by reference in their entirety.

BACKGROUND OF THE INVENTION

The present invention relates to children's toys generally and to novelty bedding in particular.

It is known in the prior art to provide novelty bedding which is convertible between a toy configuration and a bedding configuration. U.S. Pat. No. 4,754,512 (Chao-Yang), for example, discloses a stuffed animal toy which is convertible to bedding. It is believed that a new novelty bedding toy which provides novel structural and functional features providing a child user with new play activities would be desirable.

BRIEF SUMMARY OF THE INVENTION

In one aspect the invention is a combination toy chair and sleeping bag comprising a toy chair and a sleeping bag. The toy chair has a base formed from a bottom member, at least one side member and an upper member. The bottom member, at least one side member and upper member form an enclosed storage volume within the base. The storage volume is accessible though a securable opening. The upper member forms a seating surface. A back is connected to the base. The sleeping bag is connected to the base and is sized to be completely stored within the storage volume. The combination toy chair and sleeping bag is convertible between a chair configuration and a bedding configuration.

In a second aspect, the invention is a combination toy chair and sleeping bag comprising a toy chair and a sleeping bag. The toy chair has a base formed from a bottom member, at least one side member and an upper member. The bottom member, at least one side member and upper member form an enclosed storage volume within the base. The storage volume is accessible through a securable opening. The upper member forms a seating surface. A back is connected to the base. A pair of arms is connected to at least one of the back and the base. The sleeping bag is sized to be completely stored within the storage volume. The combination toy chair and sleeping bag is convertible between a chair configuration and a bedding configuration.

In yet a third aspect, the invention is a combination toy piece of furniture and sleeping bag comprising a base formed from a bottom member, at least one side member and an upper member. The bottom member, at least one side member and upper member form an enclosed storage volume within the base. The enclosed storage volume is accessible through a securable opening. The sleeping bag is sized to be completely stored within the storage volume. The combination is convertible between a first configuration wherein the sleeping bag is stored within the storage volume and the combination forms a toy piece of furniture and a second configuration wherein the sleeping bag is removed from the storage volume and the combination forms a sleeping bag bed.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
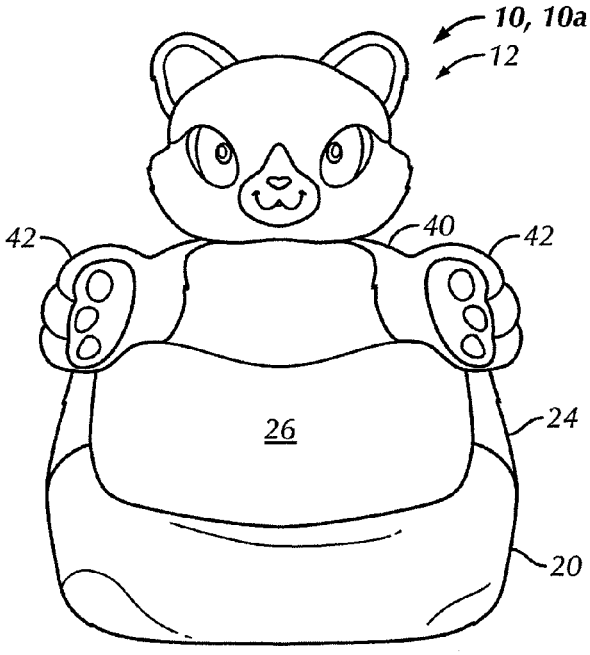
FIG. 1 is an upper front perspective view of a combination toy chair and sleeping bag in accordance with an embodiment of the present invention, showing the combination toy chair and sleeping bag in a chair configuration.
Figure 2:
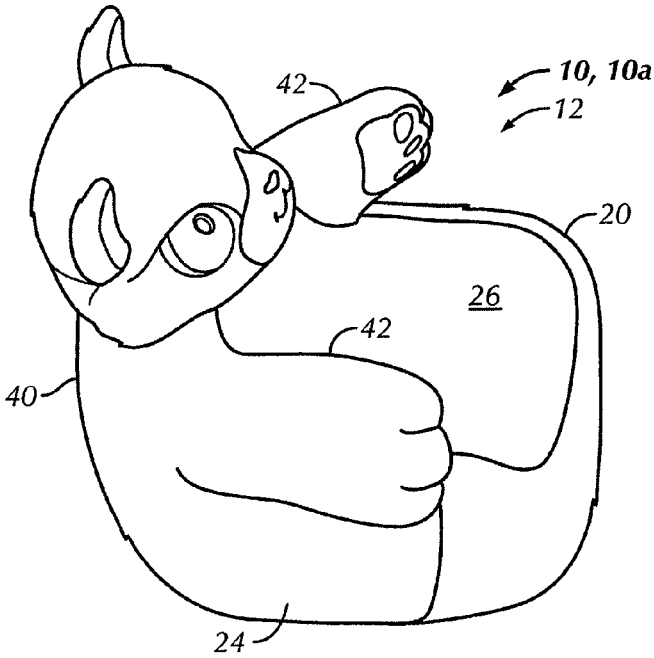
FIG. 2 is a upper side perspective view of the combination toy chair and sleeping bag of FIG. 1.
Figure 3:
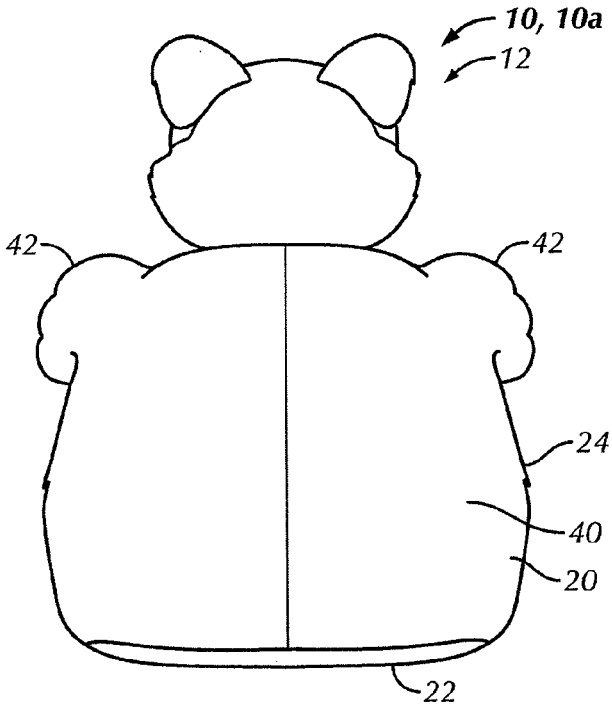
FIG. 3 is a rear elevation view of the combination toy chair and sleeping bag of FIG. 1.
Figure 4:
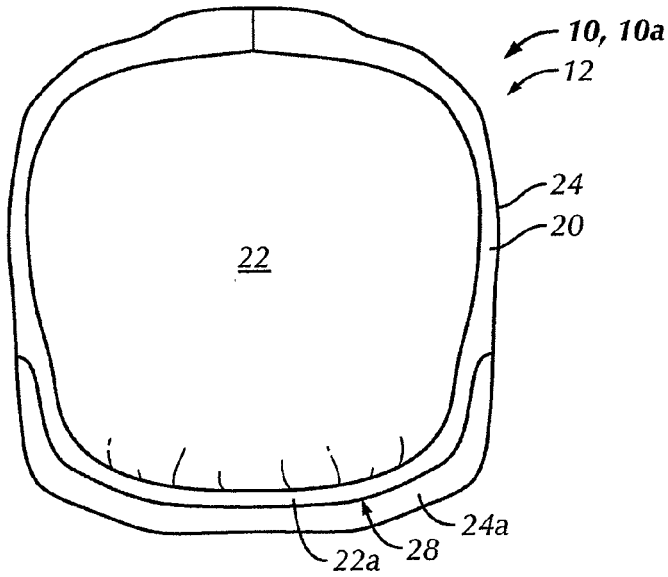
FIG. 4 is a bottom plan view of the combination toy chair and sleeping bag of FIG. 1.

FIGS. 1-7 depict a preferred embodiment of a combination toy chair and sleeping bag, indicated generally as reference numeral 10. The combination toy chair and sleeping bag 10 comprises a toy piece of furniture, preferably a chair 12, and a sleeping bag 50. The combination toy chair and sleeping bag 10 is convertible between a chair configuration 10*a* and a bedding configuration 10*b*.

With particular reference to FIGS. 1-5, the chair 12 includes a base 20 and a back 40. The base 20 is formed from a bottom member 22, at least one side member 24, and an upper member 26, forming a seating surface. In the embodiment illustrated, the base 20 has four side members 24. The bottom member 22, at least one side member 24, and upper member 26 form an enclosed cavity or storage volume 32 which is accessible through a securable opening 28. The storage volume 32 is sized to completely receive the sleeping bag 50. In the embodiment illustrated, the opening 28 is formed by a forward edge 22*a* of the bottom member and a lower edge 24*a* of a forward side member 24. The opening 28 may be secured closed by fasteners 30. In the embodiment illustrated, the opposing edges 22*a* and 24*a* of the opening 28 are provided with conventional hook and loop fasteners (such as the hook and loop fastener sold under the trademark VELCRO). Alternatively, other types of conventional fasteners, such as zippers, buttons and mating button holes, or snap fasteners, could be used.

The back 40 is connected to the base 20. Preferably, the back 40 is made to resemble at least a portion of an upper torso and head of an animal, such as a bear, as illustrated. Arms 42 may be provided and are connected to either the back 40, the base 20, or both. In the embodiment illustrated, the arms 42 are made to resemble the arms of an animal.

Preferably, the base 20, back 40 and arms 42 are formed from soft cloth material, such as velour. The bottom member 22, upper member 26, back 40 and arms 42 are each preferably filled with a soft, readily deformable material. Preferably the back 40 and arms 42 are fully stuffed with compressible foam or similar batting material, providing volume and preferably structure to each of these elements. The bottom member 22, upper member 26, back 40 and arms 42 thus each preferably form a resiliently flexible cushion. Preferably, the material used to fabricate the base 20, back 40, and arms 42 is machine washable.

In the chair configuration 10*a*, the sleeping bag 50 is stored within the storage volume 32, and provides fill material to fully expand the base 20, and provide partial support for the seating surface formed by upper member 26.

Figure 7:
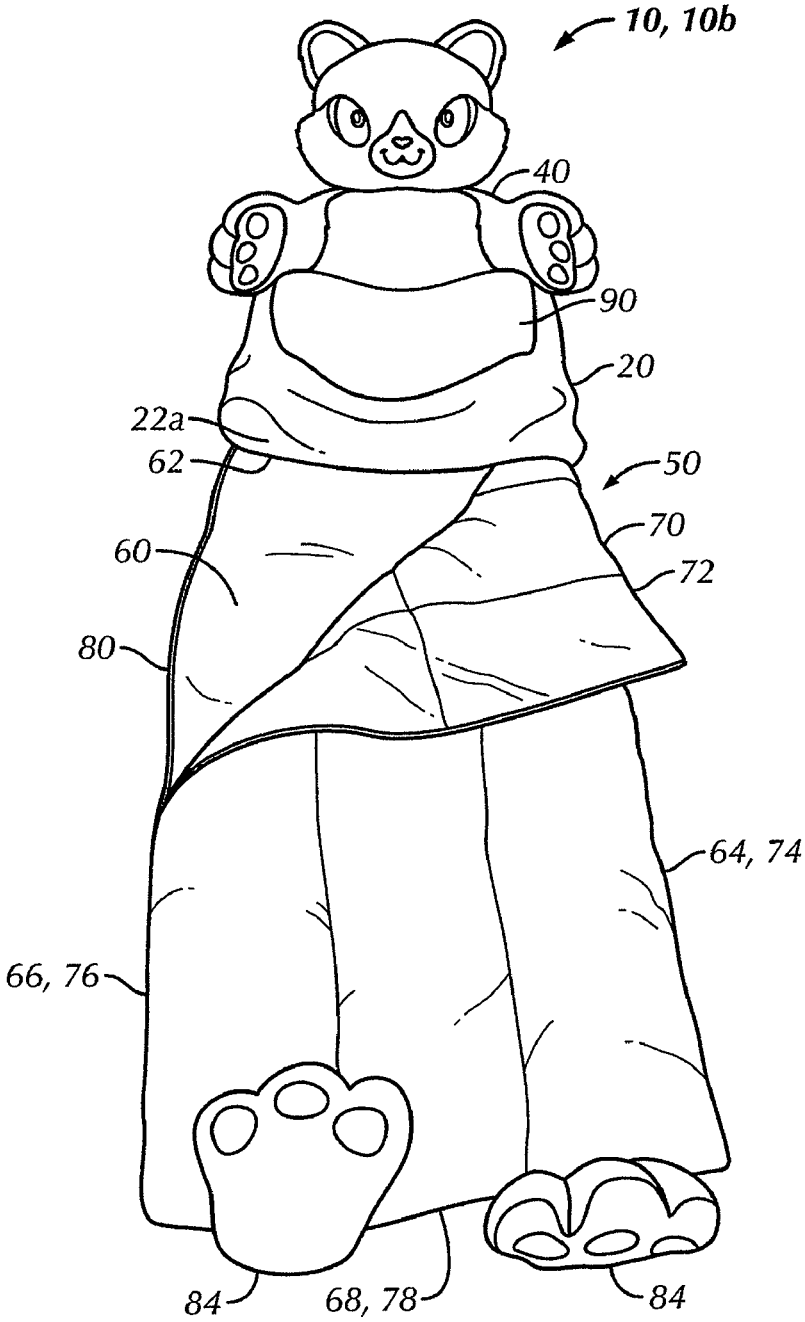
FIG. 7 is an upper front perspective view of the combination toy chair and sleeping bag of FIG. 1, showing the combination toy chair and sleeping bag in a bedding configuration

With particular reference now to FIG. 7, sleeping bag 50 is generally conventional. The sleeping bag 50 includes a bottom layer or first portion 60 and an upper layer or second portion 70. The first and second portions 60, 70 may be a single ply of fabric, or more preferably may be a quilted multi-layered fabric baffle construction, for example, top and bottom layers with soft insulating material captured therebetween. The first and second portions 60, 70 are preferably shaped as rectangles, the first portion 60 having first, second, third, and fourth edges 62, 64, 66, and 68, respectively; and the second portion 70 also having first, second, third, and fourth edges 72, 74, 76, and 78, respectively.

In the embodiment illustrated, the sleeping bag 50 is fixedly connected to the base 20 by conventional sewn stitches connecting the first portion first edge 62 to the bottom member forward edge 22*a*. Alternatively, the sleeping bag 50 could be releasably connected to the base 20 by conventional fasteners such as a zipper or cooperating buttons and button holes or hook and loop fasteners. As yet another alternative, the sleeping bag 50 could be separate from the base 20.

As shown in the illustrated embodiment, the first and second portions 60, 70 are preferably fixedly joined along entire second edges 64, 74 as well as along entire fourth edges 68, 78. Furthermore, the first and second portions 60, 70 are fixedly joined along a portion of third edges 66, 76. A remainder of the third edges 66, 76 are releasably connectable, for example by a zipper 80.

Preferably, and as shown in the embodiment illustrated, novelty animal feet 84 are fixedly connected to the sleeping bag 50 along the fourth edges 68, 78. The novelty feet 84 are preferably fabricated from a soft, plush velour material similar to that used to fabricate the base 20 and back 40.

Figure 6:
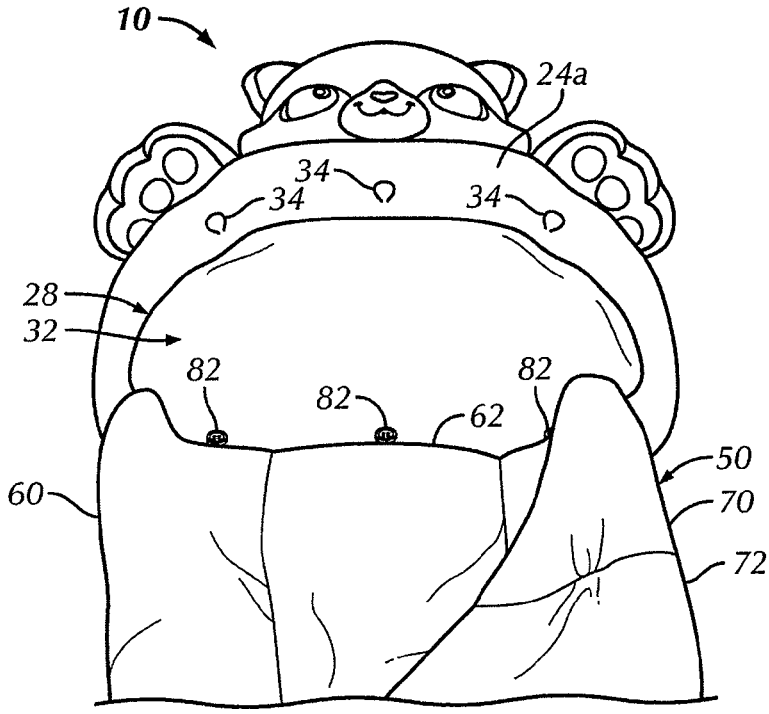
FIG. 6 is a lower front perspective view of the combination toy chair and sleeping bag of FIG. 5, showing the sleeping bag removed from the storage volume, and exposing the storage volume.

With particular reference now to FIG. 6, preferably one or more buttons 82 are fixedly connected to the sleeping bag 50 along the first portion first edge 62. The buttons 82 cooperate with appropriately sized elastic connectors 34 extending from the forward side member 24. When the combination toy chair and sleeping bag 10 is placed in the bedding configuration 10*b*, the elastic connectors 34 are preferably connected to the buttons 82 to seal the storage volume 32.

Figure 5:
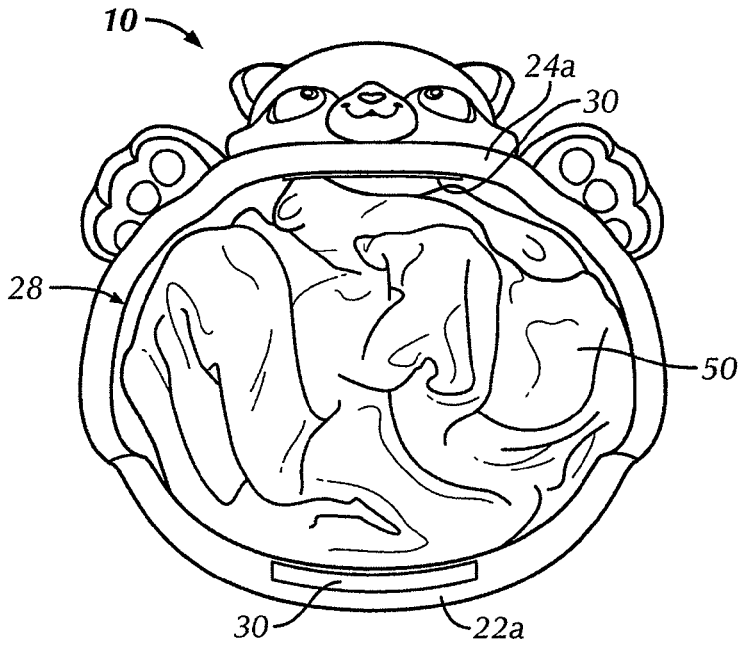
FIG. 5 is a lower front perspective view of the combination toy chair and sleeping bag of FIG. 1, showing an opening in a base member opened, exposing a sleeping bag stored within a storage volume within the base member.

With particular reference now to FIGS. 5-7, in use the combination toy chair and sleeping bag 10 is converted from the chair configuration 10*a* into the sleeping bag configuration 10*b* by removing the sleeping bag 50 from the base 20 through the opening 28 and then extending the first and second portions 60, 70 out away from the base 20. The elastic connectors 34 may then be engaged with buttons 82 to close the storage volume 32. The bottom and upper members 22, 26 form a pillow 90 upon which the user may rest the user's head.

Following use in the bedding configuration 10*b*, the user can return the combined toy chair and sleeping bag 10 to the chair configuration 10*a* by disengaging the elastic connectors 34 from the buttons 82 (if provided), to access the storage volume 32. The sleeping bag 50 may then be stuffed into the storage volume 32, and the securable opening 28 secured closed using fasteners 30 with the sleeping bag 50 fully enclosed within the storage volume 32.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A combination toy chair and sleeping bag comprising:

a toy chair having:

a base formed from a bottom member, at least one side member and an upper member, wherein the bottom member, at least one side member and upper member form an enclosed storage volume within the base, the storage volume being accessible through a securable opening, and wherein the upper member forms a seating surface, a back connected to the base;

a pair of arms connected to at least one of the back and the base; and a sleeping bag sized to be completely stored within the storage volume, wherein the combination toy chair and sleeping bag is convertible between a chair configuration and a bedding configuration, wherein the upper member forms an exposed upper side of the base, wherein the back extends upwardly from a back edge of the upper side of the base, and wherein the arms extend from proximal the back longitudinally along either lateral edge of the upper side of the base toward a forward edge of the upper side of the base whereby the upper side of the base is substantially surrounded along three of four edges by the back and the arms.

2. The combination toy chair and sleeping bag of claim 1, wherein the back and at least one of the bottom member and upper member form a resiliently flexible cushion.

3. The combination toy chair and sleeping bag of claim 1, wherein at least a portion of the base forms a pillow at a first end of the sleeping bag.

4. The combination toy chair and sleeping bag of claim 1, wherein the back is made to resemble at least a portion of an upper torso and a head of an animal.

5. The combination toy chair and sleeping bag of claim 4, further comprising novelty animal feet attached to an end of the sleeping bag.

6. The combination toy chair and sleeping bag of claim 1 wherein the base and back are made, at least in part, of velour material.

7. The combination toy chair and sleeping bag of claim 1, wherein the sleeping bag is releasably connectable to the base.

8. The combination toy chair and sleeping bag of claim 1, wherein the back is made to resemble at least a portion of an upper torso and head of an animal.

9. The combination toy chair and sleeping bag of claim 8, wherein the animal is a bear.

10. The combination toy chair and sleeping bag of claim 8 wherein the back is configured as the upper torso and head of an animal.

11. The combination toy piece of furniture and sleeping bag of claim 10 wherein in at least the chair configuration with the entire sleeping bag stored in the storage volume between the upper and lower sides of the base, the lower member forms a generally flat bottom surface of the base opposing the substantially flat seating surface of the upper side.

12. The combination toy chair and sleeping bag of claim 1 wherein in the chair configuration the sleeping bag is stored within the storage volume and the combination forms a toy piece of furniture and wherein in the bedding configuration the sleeping bag is removed from the storage volume and the combination forms a sleeping bag bed.

13. The combination toy chair and sleeping bag of claim 1 wherein the base is made, at least in part, of velour material.

14. The combination chair and sleeping bag of claim 1 wherein in at least the chair configuration with the entire sleeping bag stored in the storage volume, the exposed upper side of the base presents a substantially flat seating surface cushioned by the sleeping bag.

* * * * *